US012595530B2

(12) United States Patent
Brodjonegoro et al.

(10) Patent No.: US 12,595,530 B2
(45) Date of Patent: Apr. 7, 2026

(54) SYSTEM AND METHOD FOR REGULATING ALUMINUM PRECIPITATION DURING HIGH-PRESSURE ACID LEACHING OF LATERITE NICKEL ORE

(71) Applicants: PT QMB NEW ENERGY MATERIALS, Jakarta Selatan (ID); PT ESG NEW ENERGY MATERIAL, Jakarta Selatan (ID); GEM CO., LTD., Shenzhen (CN); PT GEM INDONESIA NEW ENERGY MATERIALS, Jakarta Selatan (ID)

(72) Inventors: Satryo Soemantri Brodjonegoro, Jakarta Selatan (ID); Kaihua Xu, Shenzhen (CN); Tegar Mukti Aji, Jakarta Selatan (ID); Rizky Wanaldi, Jakarta Selatan (ID); Andi Syaputra Hasibuan, Jakarta Selatan (ID); Evan Wahyu Kristiyanto, Jakarta Selatan (ID); Emil Salim, Jakarta Selatan (ID); Yi Wang, Jakarta Selatan (ID)

(73) Assignees: PT QMB NEW ENERGY MATERIALS, Jakarta Selatan (ID); PE ESG NEW ENERGY MATERIAL, Jakarta Selatan (ID); GEM CO., LTD., Shenzhen (CN); PT GEM INDONESIA NEW ENERGY MATERIALS, Jakarta Selatan (ID)

( * ) Notice: Subject to any disclaimer, the term of this patent is extended or adjusted under 35 U.S.C. 154(b) by 0 days.

(21) Appl. No.: 18/870,463

(22) PCT Filed: Jun. 29, 2023

(86) PCT No.: PCT/CN2023/103762
§ 371 (c)(1),
(2) Date: Nov. 29, 2024

(87) PCT Pub. No.: WO2025/000331
PCT Pub. Date: Jan. 2, 2025

(65) Prior Publication Data
US 2025/0163539 A1 May 22, 2025

(51) Int. Cl.
*C22B 3/02* (2006.01)
*C22B 3/00* (2006.01)

(52) U.S. Cl.
CPC ..... *C22B 3/02* (2013.01); *C22B 23/0415* (2013.01)

(58) Field of Classification Search
CPC ..... C22B 3/02
See application file for complete search history.

(56) References Cited

U.S. PATENT DOCUMENTS 4,374,101 A * 2/1983 Lussiez ..... C01F 7/26 510/253
2018/0030569 A1* 2/2018 Sakamoto ..... C22B 3/02

FOREIGN PATENT DOCUMENTS

CN 101139656 A 3/2008
CN 101509072 A 8/2009
(Continued)

OTHER PUBLICATIONS

CN 107099679 A Machine Translation, originally published Aug. 29, 2017, translated Mar. 11, 2024 (Year: 2017).*
(Continued)

*Primary Examiner* — Keith D. Hendricks
*Assistant Examiner* — Nikolas Takuya Pullen

(57) ABSTRACT

Disclosed is a system and method for regulating aluminum precipitation during high-pressure acid leaching of laterite nickel ore, the system comprises an autoclave, a subsequent processing equipment, and a control device; the autoclave
(Continued)

comprises a kettle body, a first feeding pipe, a second feeding pipe, and a discharge pipe, the subsequent processing equipment is connected to the discharge pipe and is used to process the reactants; the control device comprises a first valve, a second valve, a first pressure sensor, a second pressure sensor, an aluminum ion detection device, and a control unit. This disclosure can maintain the aluminum ion concentration in the leachate within an appropriate range, effectively reducing fluctuations in the production process, achieving stable production, and lowering production and maintenance costs.

11 Claims, 1 Drawing Sheet

(56) References Cited

FOREIGN PATENT DOCUMENTS

| | | | |
|---|---|---|---|
| CN | 103757261 | A | 4/2014 |
| CN | 107099679 | A | 8/2017 |
| CN | 109837386 | A | 6/2019 |
| CN | 110541081 | A | 12/2019 |
| CN | 115896451 | A | 4/2023 |
| JP | 2019000834 | A | 1/2019 |

OTHER PUBLICATIONS

International Search Report issued in corresponding International application No. PCT/CN2023/103762, mailed Dec. 12, 2023 (10 pages).

Written Opinion of the International Search Authority in corresponding International application No. PCT/CN2023/103762, mailed Dec. 12, 2023 (8 pages).

* cited by examiner

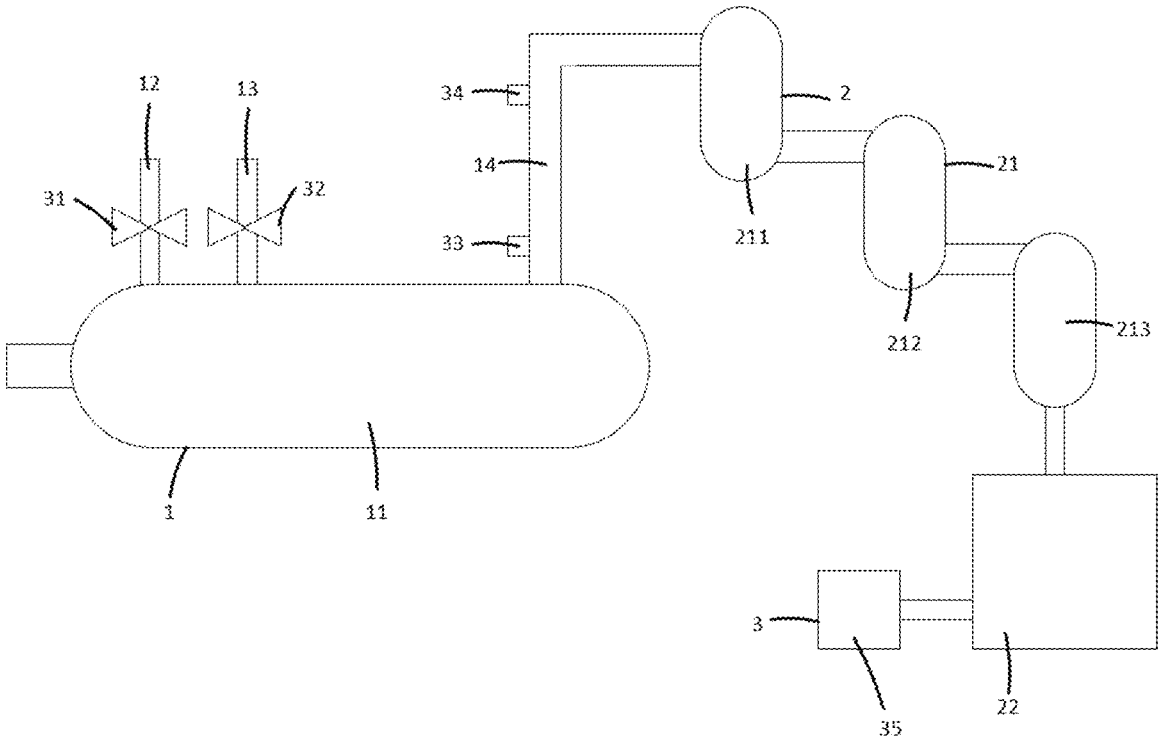
12
13
31
32
34
14
33
2
211
21
212
213
1
11
3
35
22

SYSTEM AND METHOD FOR REGULATING ALUMINUM PRECIPITATION DURING HIGH-PRESSURE ACID LEACHING OF LATERITE NICKEL ORE

FIELD OF THE DISCLOSURE

The disclosure relates to the technical field of nickel ore processing, in particular to a system and method for regulating aluminum precipitation during high-pressure acid leaching of laterite nickel ore.

BACKGROUND

Laterite nickel ore is an aggregated oxide containing nickel, iron, magnesium, cobalt, silicon, aluminum, and other elements, formed through long-term geological processes such as weathering, leaching, impregnation, and alteration of nickel-bearing olivine bedrock in tropical or subtropical regions. The iron element in it, due to severe oxidation, is in a valence state of +3, resulting in an overall reddish-brown appearance, hence its name laterite nickel ore. Unlike nickel sulfide ore, laterite nickel ore is a refractory oxide ore that cannot be effectively enriched in nickel through mineral processing methods. Therefore, the prevalent approach for processing it currently involves the steps of mineral processing, high-pressure acid leaching, and extraction to recover nickel from laterite nickel ore.

During the high-pressure leaching process of laterite nickel ore, the presence of aluminum can adversely affect production. In existing technologies, for example, a Chinese patent with publication number CN107099679A discloses a method for inhibiting aluminum leaching by adding sodium sulfate or potassium sulfate. By adding inhibitors, aluminum leaching in the autoclave is suppressed.

However, it faces the following issues: In reality, both excessively high and low aluminum content in the leachate can adversely affect production. Excessively high aluminum leaching rates consume significant amounts of neutralizing agents during subsequent pre-neutralization and iron-aluminum precipitation stages, generating large amounts of residue and imposing a greater production burden on subsequent processes. Conversely, excessively low aluminum leaching rates result in substantial hydrolysis of aluminum mainly in the autoclave and discharge pipes, producing significant amounts of scaling that increases the frequency of shutdowns for cleaning, thereby reducing production efficiency. Therefore, it is necessary to balance the leaching amount of aluminum to ensure that the leaching amount of aluminum element is neither too high nor too low to maintain production stability and reduce production costs.

SUMMARY

The purpose of this disclosure is to provide a system and method for regulating aluminum precipitation during high-pressure acid leaching of laterite nickel ore to maintain the leaching amount of aluminum element within an appropriate range to improve production stability and reduce production costs.

In order to solve the above technical problems, this disclosure provides a system for regulating aluminum precipitation during high-pressure acid leaching of laterite nickel ore, comprising:

an autoclave, which comprises a kettle body, a first feeding pipe, a second feeding pipe, and a discharge pipe, the kettle body is equipped with material inlets for adding materials; the first feeding pipe and the second feeding pipe are respectively connected to the interior of the kettle body, and are used to add a promoter that enhances the hydrolysis and precipitation of aluminum elements and an inhibitor that suppresses the hydrolysis and precipitation of aluminum elements into the kettle body; the discharge pipe is connected to the kettle body and is used to discharge the reactants within the kettle body;

a subsequent processing equipment, which is connected to the discharge pipe and is used to process the reactants; and, a control device, which comprises a first valve, a second valve, a first pressure sensor, a second pressure sensor, an aluminum ion detection device, and a control unit; the first valve is installed on the first feeding pipe, and the second valve is installed on the second feeding pipe; the first pressure sensor is located inside the discharge pipe near the end connected to the kettle body, while the second pressure sensor is located inside the discharge pipe near the end connected to the subsequent processing equipment; the aluminum ion detection device is connected to the subsequent processing equipment and is used to detect the concentration of aluminum ions within the subsequent processing equipment; the control unit is connected to the first valve, the second valve, the first pressure sensor, the second pressure sensor, and the aluminum ion detection device; the control unit receives the detection results from the first pressure sensor, the second pressure sensor, and the aluminum ion detection device, and determines the flow rate of the promoter or inhibitor based on the comparison between the pressure difference between the first pressure sensor and the second pressure sensor and a first preset range, as well as the comparison between the aluminum ion concentration and a second preset range.

Furthermore, the control unit is also used for: when the detection result of the aluminum ion detection device is above a second preset range, increasing opening degree of the second valve until the detection result of the aluminum ion detection device falls back within the second preset range; and when the detection result of the aluminum ion detection device is below the second preset range, increasing opening degree of the first valve until the detection result of the aluminum ion detection device rises within the second preset range.

Furthermore, the control unit is also used for: increasing opening degree of the second valve when the pressure difference between the first pressure sensor and the second pressure sensor exceeds a first preset range.

Furthermore, the control device also comprises an early warning device that is electrically connected to the control unit; when the control unit determines that pipe scaling cannot be alleviated, it drives the early warning device to issue a warning message.

Furthermore, the condition for the control unit to determine that pipe scaling cannot be alleviated is when the pressure difference between the first pressure sensor and the second pressure sensor exceeds the first preset range and the opening degree of the second valve has reached its maximum.

Furthermore, the promoter is $MgSO_4$.

Furthermore, the subsequent processing equipment comprises a flash evaporation mechanism and a leachate storage tank; the flash evaporation mechanism is connected to the discharge pipe, and the leachate storage tank is connected to the flash evaporation mechanism; the aluminum ion detection device is connected to the leachate storage tank and is used to detect aluminum ion concentration in the leachate stored within the leachate storage tank; the flash evaporation mechanism is used for flash evaporation treatment of the slurry, while the leachate storage tank is used for storing the leachate.

This disclosure also provides a method for regulating aluminum precipitation during high-pressure acid leaching of laterite nickel ore, which is based on the system for regulating aluminum precipitation during high-pressure acid leaching of laterite nickel ore, the method comprises the following steps:

- obtaining the concentration of aluminum ions in the leachate and assessing whether it falls within a second preset range. If the concentration exceeds the second preset range, gradually increase the flow rate of either the inhibitor or the promoter until the concentration of aluminum ions returns to the second preset range;
- obtaining the pressure difference across the discharge pipe, assessing whether it falls within a first preset range, and if it exceeds the first preset range, gradually increase the flow rate of the inhibitor being added.

Furthermore, the step of collecting the concentration of aluminum ions in the leachate, assessing whether it is within a second preset range, and if not, gradually increasing the addition of either the inhibitor or the promoter until the aluminum ion concentration reaches the second preset range, comprises the following steps:

- obtaining concentration of aluminum ions in the leachate and assessing whether it falls within a second preset range;
- if the concentration is above the second preset range, increasing opening degree of the second valve until the aluminum ion concentration falls back within the second preset range;
- if the concentration is below the second preset range, increasing opening degree of the first valve until the aluminum ion concentration increases to within the second preset range.

Furthermore, the step of obtaining the pressure difference across the discharge pipe and assessing whether it falls within the first preset range, and if it exceeds the first preset range, gradually increasing the addition of an inhibitor, comprises the following steps:

- obtaining the pressures at both ends of the discharge pipe and calculating the pressure difference between them;
- comparing the calculated pressure difference with the first preset range;
- if the pressure difference exceeds the first preset range, increasing opening degree of the second valve.

Furthermore, the method also comprises the following step: when it is determined that pipe scaling cannot be alleviated, issuing a reminder.

Furthermore, the condition for determining that pipe scaling cannot be alleviated is when the pressure difference across the discharge pipe exceeds the first preset range and the opening degree of the second valve has reached its maximum.

Compared with existing technologies, the beneficial effect of this disclosure is: this disclosure is equipped with a first valve, a second valve, a first pressure sensor, a second pressure sensor, an aluminum ion detection device, and a control unit. It can detect the pressure at both ends of the discharge pipe and the concentration of aluminum ions in the subsequent processing equipment. The control unit is capable of controlling the opening degrees of the first valve and the second valve based on the pressure difference across the discharge pipe and the aluminum ion concentration in the subsequent processing equipment, thereby adjusting the feed flow rates of the promoter and inhibitor. This enables the aluminum ion concentration in the leachate to stabilize within an appropriate range, effectively reducing fluctuations in the production process, achieving stable production, and lowering production and maintenance costs.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the FIGURES:

FIG. 1 is a schematic diagram of the system for regulating aluminum precipitation during high-pressure acid leaching of laterite nickel ore provided by this disclosure.

DETAILED DESCRIPTION OF PREFERRED EMBODIMENTS

In order to further clarify the purpose, technical solution, and advantages of the present invention, the following will provide a detailed explanation of this disclosure in conjunction with the accompanying drawings and embodiments. It should be understood that the specific embodiments described herein are only used to explain this disclosure and are not intended to limit this disclosure.

Please refer to FIG. 1, which illustrates a system for regulating aluminum precipitation during high-pressure acid leaching of laterite nickel ore provided by this disclosure. The system comprises: an autoclave 1, subsequent processing equipment 2, and a control device 3.

The autoclave 1 comprises a kettle body 11, a first feeding pipe 12, a second feeding pipe 13, and a discharge pipe 14. The kettle body 11 is equipped with material inlets for adding materials. The first feeding pipe 12 and the second feeding pipe 13 are respectively connected to the interior of the kettle body 11, and are used to add a promoter that enhances the hydrolysis and precipitation of aluminum elements and an inhibitor that suppresses the hydrolysis and precipitation of aluminum elements into the kettle body 11. The discharge pipe 14 is connected to the kettle body 11 and is used to discharge the reactants within the kettle body 11.

The subsequent processing equipment 2 is connected to the discharge pipe 14 and is used to process the reactants.

The control device 3 comprises a first valve 31, a second valve 32, a first pressure sensor 33, a second pressure sensor 34, an aluminum ion detection device 35, and a control unit. The first valve 31 is installed on the first feeding pipe 12, and the second valve 32 is installed on the second feeding pipe 13. The first pressure sensor 33 is located inside the discharge pipe 14 near the end connected to the kettle body 11, while the second pressure sensor 34 is located inside the discharge pipe 14 near the end connected to the subsequent processing equipment 2. The aluminum ion detection device 35 is connected to the subsequent processing equipment 2 and is used to detect the concentration of aluminum ions within the subsequent processing equipment 2. The control unit is connected to the first valve 31, the second valve 32, the first pressure sensor 33, the second pressure sensor 34, and the aluminum ion detection device 35. The control unit receives the detection results from the first pressure sensor 33, the second pressure sensor 34, and the aluminum ion detection device 35, and determines the flow rate of the promoter or inhibitor based on the comparison between the pressure difference between the first pressure sensor 33 and the second pressure sensor 34 and a first preset range, as well as the comparison between the aluminum ion concentration and a second preset range.

In this disclosure, the system is equipped with a first valve 31, a second valve 32, a first pressure sensor 33, a second pressure sensor 34, an aluminum ion detection device 35, and a control unit. These components enable the detection of pressure at both ends of the discharge pipe 14 and the concentration of aluminum ions within the subsequent processing equipment 2. The control unit can adjust the degree of opening of the first valve 31 and the second valve 32 based on the pressure difference across the discharge pipe 14 and the aluminum ion concentration within the subsequent processing equipment 2, thereby regulating the flow rate of the promoter and inhibitor. This ensures that the aluminum ion concentration remains stable within an appropriate range, effectively reducing fluctuations during the production process, achieving stable production, and lowering production and maintenance costs.

Specifically, the inner wall of the kettle body 11 is equipped with a titanium infiltration layer, which can provide corrosion resistance and extend its service life.

Specifically, the material inlets comprise a first inlet for adding slurry, a second inlet for adding sulfuric acid, and a third inlet for introducing steam.

Specifically, the promoter is $MgSO_4$.

Specifically, the inhibitor is alunite.

Specifically, the subsequent processing equipment 2 comprises a flash evaporation mechanism 21 and a leachate storage tank 22. The flash evaporation mechanism 21 is connected to the discharge pipe 14, and the leachate storage tank 22 is connected to the flash evaporation mechanism 21. The aluminum ion detection device 35 is connected to the leachate storage tank 22 and is used to detect aluminum ion concentration in the leachate stored within the leachate storage tank 22. The flash evaporation mechanism 21 is used for flash evaporation treatment of the slurry, while the leachate storage tank 22 is used for storing the leachate.

Furthermore, the flash evaporation mechanism 21 comprises a first-stage flash evaporator 211, a second-stage flash evaporator 212, and a third-stage flash evaporator 213. The first-stage flash evaporator 211, the second-stage flash evaporator 212, and the third-stage flash evaporator 213 are connected in sequence. The first-stage flash evaporator 211 is connected to the discharge pipe 14, and the third-stage flash evaporator 213 is connected to the leachate storage tank 22.

Furthermore, the control unit is also used for: when the detection result of the aluminum ion detection device 35 is above a second preset range, increasing opening degree of the second valve 32 until the detection result of the aluminum ion detection device 35 falls back within the second preset range; and when the detection result of the aluminum ion detection device 35 is below the second preset range, increasing opening degree of the first valve 31 until the detection result of the aluminum ion detection device 35 rises within the second preset range.

Furthermore, the control unit is also used for: increasing opening degree of the second valve 32 when the pressure difference between the first pressure sensor 33 and the second pressure sensor 34 exceeds a first preset range.

Furthermore, the control device also comprises an early warning device that is electrically connected to the control unit. When the control unit determines that pipe scaling cannot be alleviated, it drives the early warning device to issue a warning message.

Furthermore, the condition for the control unit to determine that pipe scaling cannot be alleviated is when the pressure difference between the first pressure sensor 33 and the second pressure sensor 34 exceeds the first preset range and the opening degree of the second valve 32 has reached its maximum.

This disclosure also provides a method for regulating aluminum precipitation during high-pressure acid leaching of laterite nickel ore, based on the system for regulating aluminum precipitation during high-pressure acid leaching of laterite nickel ore. The method comprises the following steps:

- obtaining the concentration of aluminum ions in the leachate and assessing whether it falls within a second preset range. If the concentration exceeds the second preset range, gradually increase the flow rate of either the inhibitor or the promoter until the concentration of aluminum ions returns to the second preset range;
- obtaining the pressure difference across the discharge pipe, assessing whether it falls within a first preset range, and if it exceeds the first preset range, gradually increase the flow rate of the inhibitor being added.

Furthermore, the step of collecting the concentration of aluminum ions in the leachate, assessing whether it is within a second preset range, and if not, gradually increasing the addition of either the inhibitor or the promoter until the aluminum ion concentration reaches the second preset range, specifically comprises the following:

- obtaining concentration of aluminum ions in the leachate and assessing whether it falls within a second preset range;
- if the concentration is above the second preset range, increasing opening degree of the second valve until the aluminum ion concentration falls back within the second preset range;
- if the concentration is below the second preset range, increasing opening degree of the first valve until the aluminum ion concentration increases to within the second preset range.

Furthermore, the step of obtaining the pressure difference across the discharge pipe and assessing whether it falls within the first preset range, and if it exceeds the first preset range, gradually increasing the addition of an inhibitor, specifically comprises the following:

- obtaining the pressures at both ends of the discharge pipe and calculating the pressure difference between them;
- comparing the calculated pressure difference with the first preset range;
- if the pressure difference exceeds the first preset range, increasing opening degree of the second valve.

Furthermore, the method also comprises the following step: when it is determined that pipe scaling cannot be alleviated, issuing a reminder to shut down the equipment for cleaning.

Furthermore, the condition for determining that pipe scaling cannot be alleviated is when the pressure difference across the discharge pipe exceeds the first preset range and the opening degree of the second valve has reached its maximum.

Embodiment 1

The concentration of aluminum ions in the leachate is greatly influenced by the concentration of aluminum ions in the incoming ore and the parameters of the high-pressure acid leaching process. The concentration of aluminum ions in the leachate increases as the concentration of aluminum ions in the incoming ore and the leaching temperature decrease. Therefore, to verify the effectiveness of this disclosure, the concentration of aluminum ions in the leachate after treating slurries with different concentrations of aluminum ions in the raw ore at different acid leaching temperatures was recorded before and after implementing this disclosure. The specific data is presented in the following table:

| | Raw ore aluminum ion concentration (%) | Acid leaching temperature | Aluminum ion concentration in leachate (g/L) |
|---|---|---|---|
| Before implementation | 1.14 | 250 | 5.9 |
| | 1.13 | 245 | 6.3 |
| | 1.25 | 250 | 9.8 |
| | 1.25 | 245 | 12.2 |
| After implementation | 1.15 | 250 | 6.8 |
| | 1.15 | 245 | 7.0 |
| | 1.3 | 250 | 7.1 |
| | 1.3 | 245 | 7.1 |

It can be seen that before the implementation of this disclosure, the concentration of aluminum ions in the leachate was greatly influenced by the concentration of aluminum ions in the incoming ore and the parameters of the high-pressure acid leaching process, resulting in significant fluctuations in the concentration of aluminum ions in the leachate. However, after implementing this disclosure, regardless of the variations in the concentration of aluminum ions in the raw ore and the acid leaching temperature, the fluctuations in the concentration of aluminum ions in the leachate are significantly reduced and maintained within an appropriate range, which is conducive to achieving stable production and reducing production and maintenance costs.

This disclosure has the following advantages compared to existing technologies:

This disclosure is equipped with a first valve 31, a second valve 32, a first pressure sensor 33, a second pressure sensor 34, an aluminum ion detection device 35, and a control unit. It can detect the pressure across the discharge pipe 14 and the concentration of aluminum ions in the subsequent processing equipment 2. The control unit can control the opening degrees of the first valve 31 and the second valve 32 based on the pressure difference across the discharge pipe 14 and the concentration of aluminum ions in the subsequent processing equipment 2, adjusting the flow rates of the promoter and inhibitor added, thereby stabilizing the concentration of aluminum ions in the leachate within an appropriate range. This effectively reduces fluctuations in the production process, enabling stable production and lowering production and maintenance costs.

The specific embodiments of this disclosure described above do not constitute limitations on the scope of protection of this disclosure. Any other corresponding changes and modifications made based on the technical concept of this disclosure should be included within the scope of protection of this disclosure.

What is claimed is:

1. A system for regulating aluminum precipitation during high-pressure acid leaching of laterite nickel ore, comprising:

an autoclave, which comprises a kettle body, a first feeding pipe, a second feeding pipe, and a discharge pipe, wherein the kettle body is equipped with material inlets for adding materials; wherein the first feeding pipe and the second feeding pipe are respectively connected to an interior of the kettle body, and are capable of adding a promoter that enhances the hydrolysis and precipitation of aluminum elements and an inhibitor that suppresses the hydrolysis and precipitation of aluminum elements into the kettle body; the discharge pipe is connected to the kettle body and is capable of discharging reactants within the kettle body;

a subsequent processing equipment comprising a flash evaporation mechanism and a leachate storage tank, wherein the subsequent processing equipment is connected to the discharge pipe and is capable of processing the reactants; and, a control device, which comprises a first valve, a second valve, a first pressure sensor, a second pressure sensor, an aluminum ion detection device, and a control unit; wherein the first valve is installed on the first feeding pipe, and the second valve is installed on the second feeding pipe; wherein the first pressure sensor is located inside an end of the discharge pipe connected to the kettle body, while the second pressure sensor is located inside an end of the discharge pipe connected to the subsequent processing equipment; wherein the aluminum ion detection device is connected to the subsequent processing equipment and is capable of detecting a concentration of aluminum ions within the subsequent processing equipment; wherein the control unit is connected to the first valve, the second valve, the first pressure sensor, the second pressure sensor, and the aluminum ion detection device; the control unit receives detection results from the first pressure sensor, the second pressure sensor, and the aluminum ion detection device, and determines a flow rate of the promoter or inhibitor based on the comparison between the pressure difference between the first pressure sensor and the second pressure sensor and a first preset range, as well as the comparison between the aluminum ion concentration and a second preset range; wherein if the pressure difference between the first pressure sensor and the second pressure sensor exceeds the first preset range, the control unit increases the flow rate of the inhibitor, and wherein if the aluminum ion concentration exceeds the second preset range, the control unit increases the flow rate of the promoter or inhibitor until the aluminum ion concentration falls within the second preset range.

2. The system for regulating aluminum precipitation during high-pressure acid leaching of laterite nickel ore according to claim 1, wherein the control unit is also capable of: when the detection result of the aluminum ion detection device is above the second preset range, increasing an opening degree of the second valve until the detection result of the aluminum ion detection device falls back within the second preset range; and when the detection result of the aluminum ion detection device is below the second preset range, increasing an opening degree of the first valve until the detection result of the aluminum ion detection device rises within the second preset range.

3. The system for regulating aluminum precipitation during high-pressure acid leaching of laterite nickel ore according to claim 1, wherein the control unit is also capable of: increasing opening degree of the second valve when the pressure difference between the first pressure sensor and the second pressure sensor exceeds the first preset range.

4. The system for regulating aluminum precipitation during high-pressure acid leaching of laterite nickel ore according to claim 1, wherein the control device also comprises an early warning device that is electrically connected to the control unit; wherein when the control unit determines that pipe scaling cannot be alleviated, it drives the early warning device to issue a warning message.

5. The system for regulating aluminum precipitation during high-pressure acid leaching of laterite nickel ore according to claim 4, wherein a condition for the control unit to determine that pipe scaling cannot be alleviated is when the pressure difference between the first pressure sensor and the second pressure sensor exceeds the first preset range and the opening degree of the second valve has reached its maximum.

6. The system for regulating aluminum precipitation during high-pressure acid leaching of laterite nickel ore according to claim 5, wherein the promoter is $MgSO_4$.

7. The system for regulating aluminum precipitation during high-pressure acid leaching of laterite nickel ore according to claim 1, wherein the flash evaporation mechanism is connected to the discharge pipe, and the leachate storage tank is connected to the flash evaporation mechanism; wherein the aluminum ion detection device is connected to a leachate storage tank and is capable of detecting aluminum ion concentration in the leachate stored within the leachate storage tank; wherein the flash evaporation mechanism is capable of flash evaporation treatment of slurry, while the leachate storage tank is capable of storing the leachate.

8. A method for regulating aluminum precipitation during high-pressure acid leaching of laterite nickel ore, comprising using a system for regulating aluminum precipitation during high-pressure acid leaching of laterite nickel ore according to claim 1, the method comprises the following steps:

obtaining a concentration of aluminum ions in a leachate and assessing whether it falls within a second preset range; wherein if the concentration exceeds the second preset range, gradually increasing the flow rate of either the inhibitor or the promoter until the concentration of aluminum ions returns to the second preset range;

obtaining the pressure difference across the discharge pipe, assessing whether it falls within a first preset range, and if it exceeds the first preset range, gradually increasing the flow rate of the inhibitor being added.

9. The method for regulating aluminum precipitation during high-pressure acid leaching of laterite nickel ore according to claim 8, wherein the step of obtaining the concentration of aluminum ions in the leachate and assessing whether it is within a second preset range; wherein if the concentration exceeds the second preset range, gradually increasing the flow rate of either the inhibitor or the promoter until the concentration of aluminum ions returns to the second preset range, comprises the following steps:

obtaining the concentration of aluminum ions in the leachate and assessing whether it falls within a second preset range;

if the concentration is above the second preset range, increasing an opening degree of the second valve until the aluminum ion concentration falls back within the second preset range;

if the concentration is below the second preset range, increasing an opening degree of the first valve until the aluminum ion concentration increases to within the second preset range.

10. The method for regulating aluminum precipitation during high-pressure acid leaching of laterite nickel ore according to claim 8, wherein the step of obtaining the pressure difference across the discharge pipe and assessing whether it falls within the first preset range, and if it exceeds the first preset range, gradually increasing the addition of an inhibitor, comprises the following steps:

obtaining pressures at both ends of the discharge pipe and calculating the pressure difference between them;

comparing the calculated pressure difference with the first preset range;

if the pressure difference exceeds the first preset range, increasing an opening degree of the second valve.

11. The method for regulating aluminum precipitation during high-pressure acid leaching of laterite nickel ore according to claim 8, wherein the method further comprises the following step:

determining that pipe scaling of the discharge pipe cannot be alleviated and sending a reminder signal for cleaning, wherein the condition for determining that pipe scaling cannot be alleviated is when the pressure difference across the discharge pipe exceeds the first preset range and the opening degree of the second valve has reached its maximum.

* * * * *